US005425321A

United States Patent [19]

Tinkler

[11] Patent Number: 5,425,321

[45] Date of Patent: Jun. 20, 1995

[54] SAILBOARD AND THE LIKE

[76] Inventor: Robert C. Tinkler, 725 Morehouse Hwy., Fairfield, Conn. 06430

[21] Appl. No.: 159,540

[22] Filed: Dec. 1, 1993

[51] Int. Cl.[6] ..... B63B 35/79

[52] U.S. Cl. ..... 114/39.2; 441/74

[58] Field of Search ..... 114/39.2, 284, 285; 441/74

[56] References Cited

U.S. PATENT DOCUMENTS 3,902,207 9/1975 Tinkler et al. ..... 441/74
3,988,794 11/1976 Tinkler et al. ..... 441/74
4,649,847 3/1987 Tinkler et al. ..... 114/39.2

*Primary Examiner*—Sherman Basinger
*Attorney, Agent, or Firm*—David Fink

[57] ABSTRACT

A sailboard for sailing in water includes an elongated hull defining fore and aft and having a top and a bottom, and a panel integrally connected to the bottom of the hull near the aft end and extending beyond the aft end. The panel is relatively rigid at its distal end. An apparatus is connected to both the hull and the panel, and is operable for moving the distal end of the panel from a first position to a second position. The hull and the panel defining a relatively continuous flat surface for the first position and defining a relatively convex surface for the second position.

3 Claims, 7 Drawing Sheets

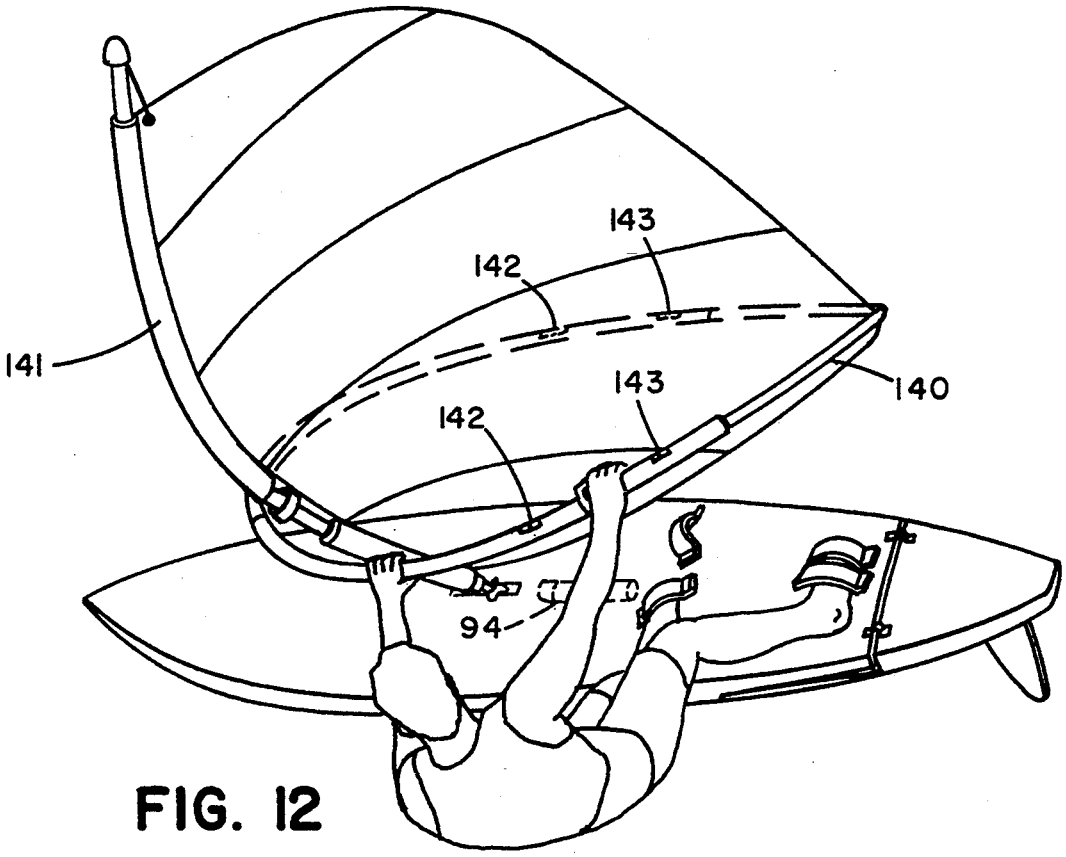
FIG. 12
FIG. 9
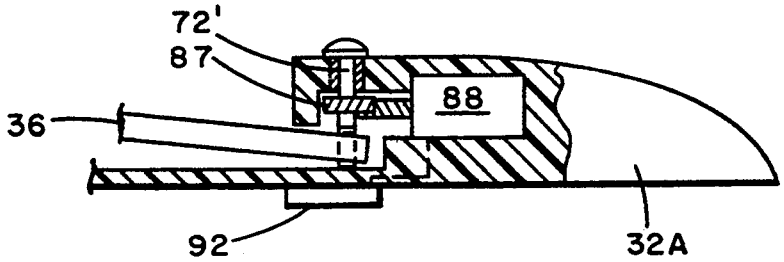
FIG. 10
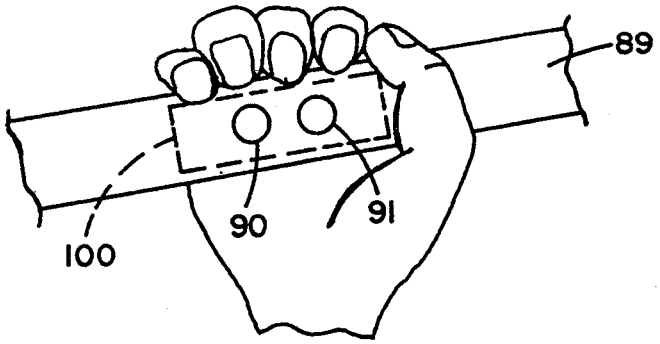

26A
36B
42A
36A
124
122
40A
50A
48A
135
126
58A
129
128
132
120
130
118
114
112
110
108
106
104
94
98
102

SAILBOARD AND THE LIKE

BACKGROUND OF THE INVENTION

1. Field of the Invention

The present invention relates to sailboards and the like and more particularly to an improved sailboard design that enhances the hydro-dynamic operation of the sailboard under different conditions and different points of sail.

It is well known that when a sailboard is under a straight run it is desirable to have more lift and hence a board with a straight tail portion is advantageous. On the other hand, when it is necessary to maneuver and turn the sailboard it is better to have a curved bottom as an upswept tail to facilitate tarns such as sharp, smooth, tight parabolic turns.

Thus, in designing state-of-the art conventional sailboards there is a required trade off between the design for maximum speed design with the straight tail the design for turns with and an upswept tail for tighter, faster, parabolic turning. The present invention achieves the advantages of both the straight tail design for speed and the upswept tail for tight, fast turning.

2. Description of the Prior Art

Over the last twenty years, there has developed various sailboard designs most of which utilize different sizes, shapes and contours depending upon the intended type of sailing, whether mostly straight away, or involving considerable maneuverability or combinations of these. A recent article, "The Bottom Line", by Randy French discusses these factors. There has also been developed sailboards with adjustable tail portions that respond to water pressure to flex a resilient tail portion. An example of the latter is U.S. Pat. No. 4,649,847 of which the present applicant is a joint patentee. The '847 patent provides a sailboard hull in which the rear portion horizontally bifurcated into an upper portion which is rigid and a lower portion which is a resilient deflection panel extending below the upper portion. The '847 patent discloses a resilient deflection panel which is responsive to water pressure to assume a predetermined contour. Other examples of similar prior art patents include U.S. Pat. No. 3,902,207 and No. 3,988,794.

SUMMARY OF THE INVENTION

It is a primary object of the present invention to provide an improved sailboard design that is effective for both high speed straight sailing and tight fast turning.

It is a further object of the present invention to provide a sailboard in which the tail section is adjustable to assume one position for maximum speed when the sailboard is going straight away and the second position for tight turning capabilities.

It is a still further object of the present invention to provide a sailboard in which the tail section may be conveniently and readily moved between the first position and the second position.

It is another object of the present invention to provide a convenient mechanism for adjusting the tail section of a sailboard by the operator when the sailboard is under way both at high speed and during turning.

The present invention provides a sailboard hull having a rear bottom portion that is a water flow deflection panel attached to the underside of the hull. The panel is conveniently raised and lowered between two distinct and predeterminable positions. When the panel is in a downward position it serves as a substantially straight extension of the underside of the hull to provide hull speed on a straightaway. On the other hand, when the panel is in its raised position the underside of the hull is curved to provide greater maneuverability.

In one embodiment of the invention, the panel is moved between its two positions by an operating mechanism which is foot controlled by the operator. A pair of pedals are provided in the deck at the rear end of the hull to be conveniently operated.

In another embodiment of the invention, the panel is motor controlled and may be moved by the operator to an optimum position for the prevailing conditions of speed, maneuver, water, etc.

A preferred embodiment or the invention is a board for transporting a person across the water such as a sailboard and includes an elongated hull defining fore and aft and having a top and a bottom; a panel integrally connected to the bottom of the hull near the aft end and extending beyond the aft end of the hull. The panel is relatively flexible near its connection to the hull and is relatively rigid at its distal end. In addition, moving means is connected to the hull and the panel, and operable for moving the distal end of the panel between a first position to a second position. The hull and the panel define a relatively continuously flat surface for the first position and define a relatively convex surface for the second position. A sailboard accommodates a mast.

Another preferred embodiment of the invention features the means including first and second pedal means operable for moving the panel between the first and the second positions.

Yet another embodiment of the invention features the moving means including an electric motor, driving means connected to the electric motor and in driving relationship to the panel for moving the panel between the first and second positions in response to the electric motor.

BRIEF DESCRIPTION OF THE DRAWINGS

The foregoing and still other objects and advantages of the present invention will be more apparent from the following detailed explanation of the preferred embodiments of the invention considered in connection with the accompanying drawings herein in which:

FIG. 9 and FIG. 10 show a portion of a modification of the invention in which fine turning of panel adjusting screw stops is done by remote control;

FIG. 12 is a perspective view of a sailboard according to the invention and an operator employing a power operated embodiment of the invention;

DESCRIPTION OF SPECIFIC EMBODIMENTS

Figure 1:
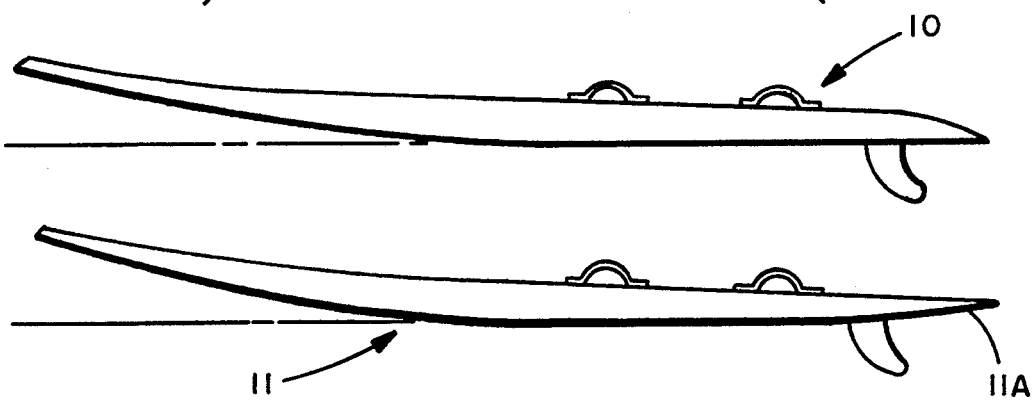
PRIOR ART FIG. 1
FIG. 1 shows side elevational views of two conventional prior art sailboards without masts, one designed for straightaway speed and the other curved aft for better maneuverability.

Referring now to the drawings and more particularly to FIG. 1, numeral 10 indicates a sailboard designed for maximum speed on a straight run and as shown, the rear portion of the underside of the hull is substantially straight to provide lift and enhance speed. In contrast to this, sailboard 11 has a convex upswept rear portion 11*a* which provides greater turning ability and general maneuverability. Sailboard 10 is designed for the speed mode and sailboard 11 is better suited for the jibe/-maneuverable mode. Various prior art sailboards are designed to be a compromise of these two designs.

Figure 2:
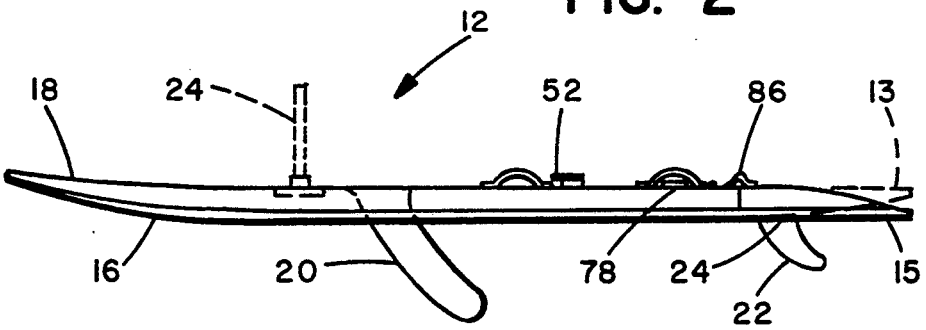
FIG. 2 is a side elevational view of one embodiment of sailboard according to the present invention in which a foot operated system is used to control the shape of the rear panel.

The present invention as shown in FIG. 2 discloses a sailboard 12 having an active tail or rear hull portion to provide a convex or upswept curved surface as shown in the dotted lines 13 for one position and a second position to provide a straight under surface as indicated by the full lines 15. As will be described hereinafter, the present invention provides a convenient, efficient and accurate angle of attack operating mechanisms for controlling the rear portion of the sail board while under way to permit the rear portion to be moved between two positions.

Figure 3:
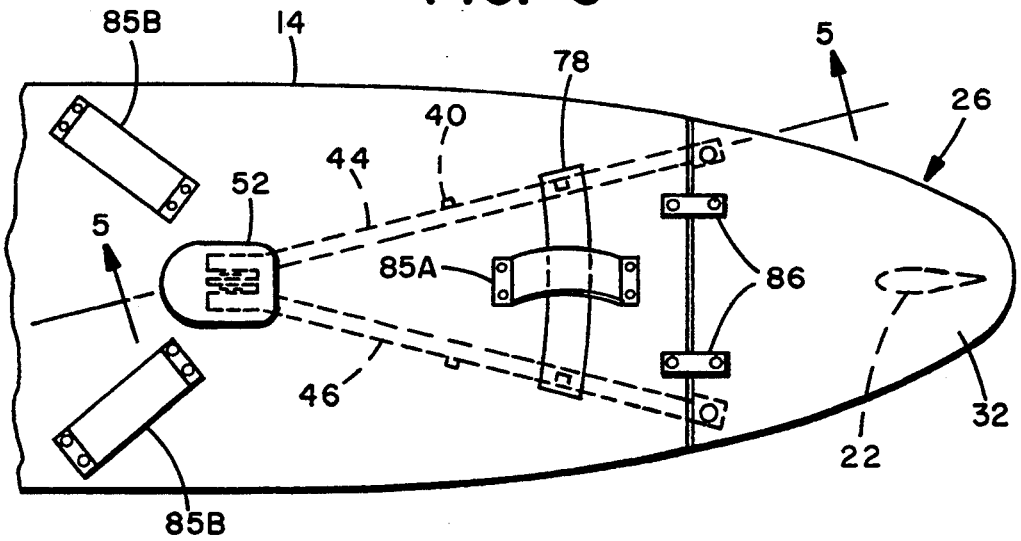
FIG. 3 is a top plan view of the rear portion of the sailboard shown in FIG. 2 on an enlarged scale.

The sailboard 12 shown in FIGS. 2 and 3 comprises a hull including a deck 14, bottom 16, and sides or rails 18, to form a watertight enclosure in the conventional manner. Typically, molded plastic and fiberglass is used. The sailboard includes suitable fins 20, 22 which may take various forms as is known in the art and a removable mast 24 (shown in dashed lines) mounted on the deck.

Figure 4:
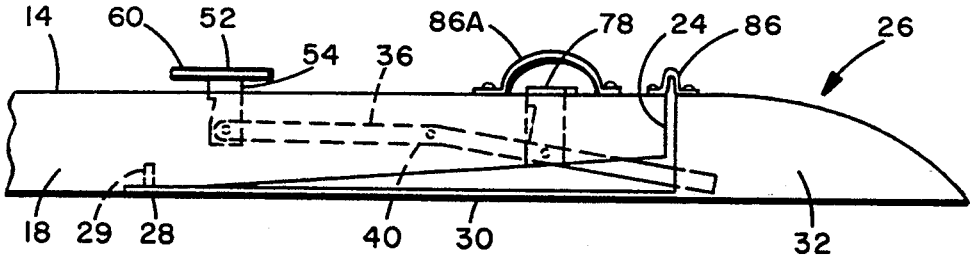
FIG. 4 is a side elevational view of the rear portion shown in FIG. 3 showing the operating mechanism.
Figure 6:
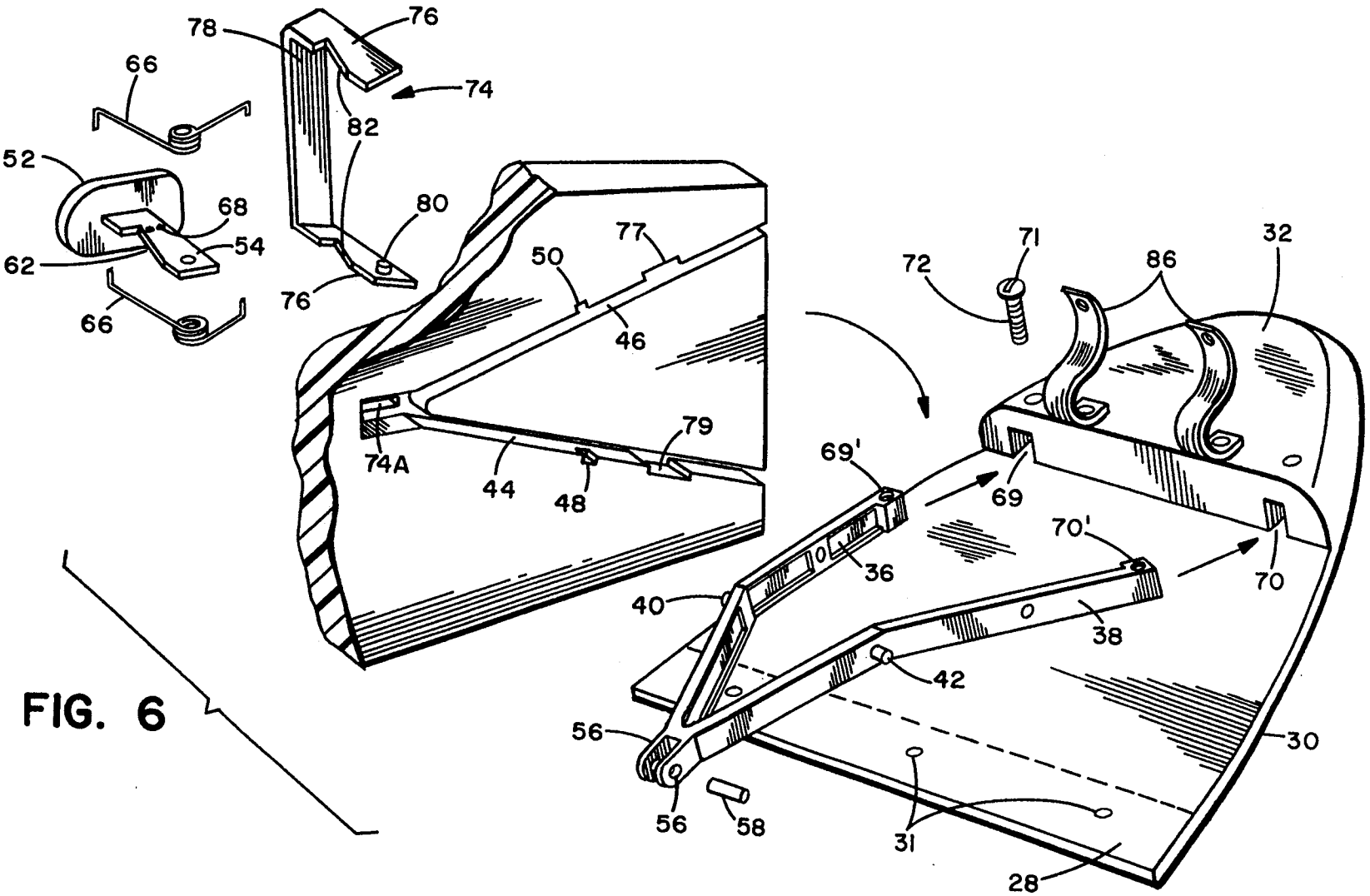
FIG. 6 is an exploded view of the operating mechanism shown in FIG. 3.
Figure 13:
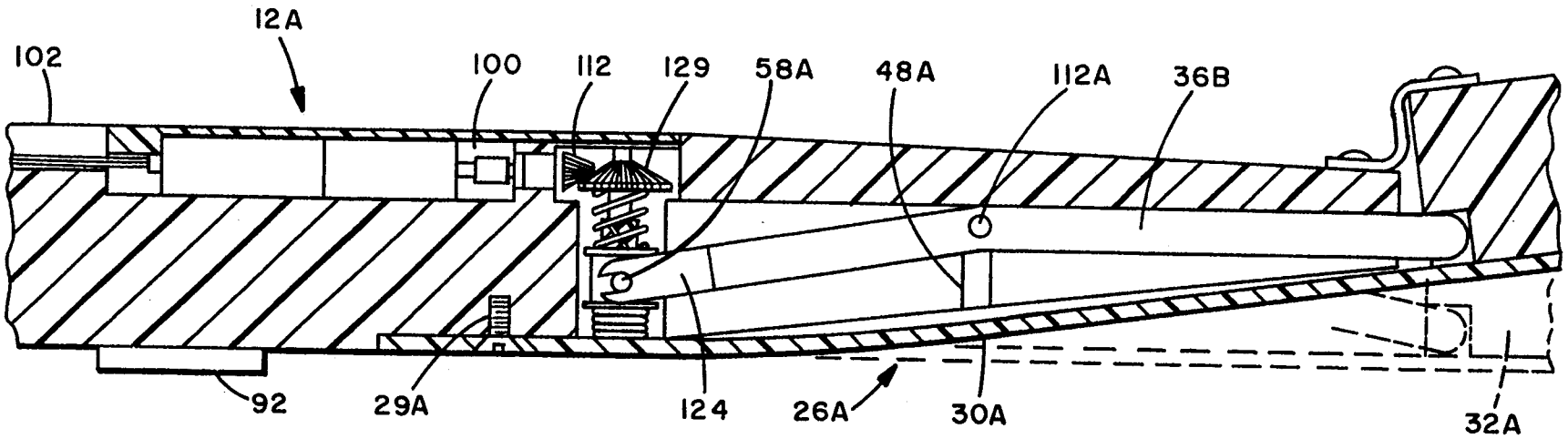
FIG. 13 is a section view of a portion of the sailboard showing the power mechanism used in FIG. 12.

The main hull of the sailboard 12 terminates in an end 24 which, in a conventional design, would be the last two-thirds of the sailboard 12. The present invention provides a rear panel 26 which may be conveniently molded of fiberglass and plastic and which is secured to the underside of the sailboard 12 at portion 28 in a hinged manner. It is seen in FIGS. 4 and 6 that the forward end portion 28 of the panel 26 provides a fastening area suitably secured to the underside of the hull of the sailboard 12 by bonding, or gluing, or screws 29 passing through holes 31. Preferably, the union is integral. The panel 26 includes a forward thin flat portion 30 and a rear watertight section 32 that extends beyond the end 24 of the hull of the sailboard 12 as shown in FIG. 4. With the panel 26 secured to the hull of the sailboard 12, it is seen that the panel 26 can pivot or bend upward and downward to different positions, thereby providing a different angle of attack contour to the underside of the sailboard 12.

The forward flat portion 30 of panel 26 is relatively flexible and springlike having its normal or static position approximately horizontal so that the bottom of the panel 26 forms a relatively continuous flat surface. That is, when free to move, the panel 26 will tend to assume its normal or straight position indicated by solid lines 15 in FIG. 2.

One embodiment for the operating mechanism for controlling the position of the panel 26 will now be described, particularly as shown in FIG. 6. There is provided a pair of pivoting arms 36, 38 having respective pivot pins 40, 42. The arms 36, 38 are received in the recess slots 44, 46 molded in the underside of the rear portion of the hull of the sailboard 12. When the arms 36, 38 are in place in the hull recess slots 44, 46, respectively, the pins 40, 42 are received in recesses 48, 50 and retained in place by plugs (not shown). The arms 36, 38 in their positions within the hull recess slots 44, 46 are more clearly shown in the cross sectional view shown in FIG. 5. Arm 36 is somewhat offset from the pivot point 40 and arm 38 is similarly offset from pivot 42. Arms 36, 38 are coupled to a foot pedal 52. The foot pedal 52 includes an upward extending member 54 which is received between the two end projections 56 of the arms 36, 38 and held in place by a pin 58. The pin 58 is secured in place in a conventional manner. The member 54 of the foot pedal 52 passes through an opening in the deck 14 and terminates in a pedal plate 60. The forward edge 62 of member 54 is tapered to provide a notch which can interact with striker plate 64. The foot pedal 52 is continually urged forward by coil springs 66, one end of each spring 66 bears against the upper edge of arm 36 and the other end received in one of the holes 68 in member 54.

Figure 5:
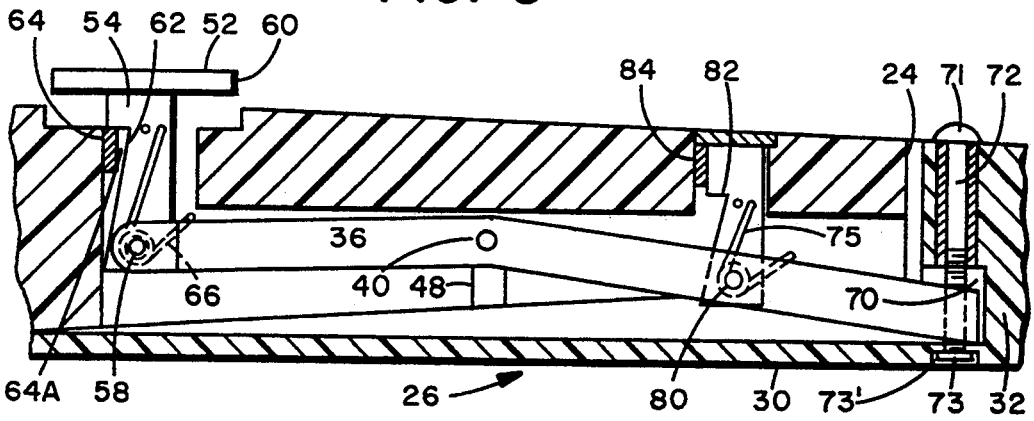
FIG. 5 is section view taken on the line 5—5 of FIG. 3 on an enlarged scale with the operating mechanism set for straight, maximum speed sailing.

It is seen that movement of the foot pedal 52 will cause the arms 36, 38 to pivot about their respective pins 40, 42. The rear ends of the arms 36, 38 are received in recesses 69, 70 formed in the panel portion 32 as seen in FIGS. 5 and 6. A pair of machine screws 72 are provided and pass through the panel portion 32 above the recesses 69, 70 and through screw threaded holes 69', 70' in respective arms 36, 38. The end of each screw 72 has a collar 73 located in a molded recess 73' in the portion 30 to turn freely. In FIG. 5, the adjusting screw 72 is shown in position passing through the end of arm 36 and threaded therein. In this manner, the screws 72 serve as a limit stop to determine the range of up and down movement of panel 32. Thus, it is seen that the screws 72 serve as a fine turning adjustment to the operator to allow the precise selection of the extent of upward and downward positions of the panel 26. The screws 72 have caps or heads 71 suitable to allow the operator to make changes manually. Such changes may occur while the sailboard 12 is underway.

Approximately midway between the rear end of each arm 36, 38 and its respective pivot point is a rear foot pedal 74 in a U-shaped construction. The arms 76 of the rear foot pedal 74 each pass through openings 77, 79 in the top of the hull of the sailboard 12 as shown in FIG. 6. The rear foot pedal 74 includes a horizontal member 78 positioned on the deck when the arms 76 are in their positions passing through the deck 14. Each arm 76 has a boss 80 which is received in its respective pivoting arm 36 as shown in FIG. 5. The rear foot pedal arms 76 have their forward edges 82 tapered in a manner similar to the taper 62 in the member 54 of the forward foot pedal 74 to provide notches which can bear against a striker plate 84 under the pressure from a coil spring 75.

Referring now especially to FIG. 5, it is readily seen that the pivoting of arms 36, 38 around their respective pivot points 40, 42 will serve to raise and lower the panel 26. It is apparent that the underside of the panel 26 is an extension of the sailboard 12 and thus the raising and lowering of the panel will change the underside angle of attack contour of the sailboard 12. In the straightaway or speed mode, the rear foot or speed trim pedal 74 will be depressed to pivot the rear end of arms 36, 38 downwardly resulting in a relatively flat hull surface. In this condition, the notch in member 54 is in contact with the top of striker plate 64 to maintain the arms in their position to keep the panel 26 downward or depressed.

When it is desirable to turn the sailboard 12, the rear panel 26 is raised to provide convex curvature. This is done by the operator depressing the (jibe) foot pedal 52 by foot to urge the pedal 52 slightly backward towards aft to release the notch 64*a* from the striker plate 64. As the (jibe) foot pedal 52 is depressed, the arms 36, 38 pivot to raise the panel 26 and the rear (speed trim) foot pedal 74 will rise and extend above the sailboard deck 14. In this new position, the notch 82 will engage striker plate 84 so that the panel 26 will be retained in its upward position. At this time the operator may fine tune the panel by appropriate manual adjustment of screws 72.

Appropriate foot straps 85*a* and 85*b* are provided to assist the operator in maintaining his feet in the proper locations. Also retainer straps 86 are secured to the rear panel 26 and adapted to secure to the sailboard 12 to prevent any possible downward pivoting of the panel 26 beyond that contemplated by the designer of the control mechanism.

Figure 7:
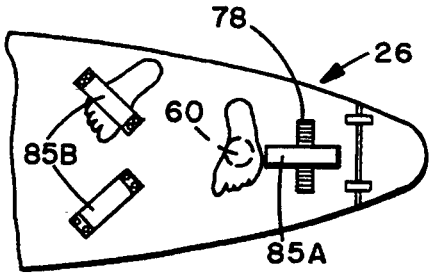
FIG. 7 and FIG. 8 are top plan views of the rear portion of the sailboard shown in FIG. 2 and showing the normal positions of the operator's feet during sailing maneuvers.
Figure 8:
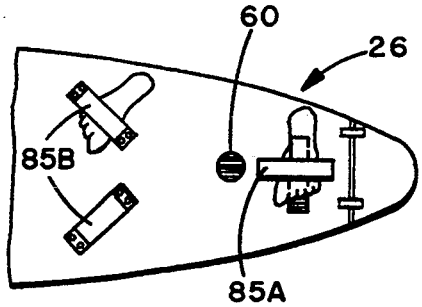

FIGS. 7 and 8 illustrate the appropriate location of the operator's feet for optimum sailing of the board and control of the rear panel from its straightaway mode to the turning mode. The straps 85*a* and 85*b* are located for optimum sailing of the board. These are positioned in accordance with the design of the particular sailboard and determine where the feet of the operator will be placed during normal sailing. It is seen that the rear speed trim pedal 74 is located under foot strap 85*a* and the forward (jibe) foot pedal 52 is located just forward of strap 85*b*. FIG. 7 shows the positions of the operator's feet during the turning or maneuverability mode. The right foot is under one of the straps 85*b* on the starboard side of the sailboard 12 whereas the left foot is in the position for depressing forward foot pedal 52 to raise the rear panel 26. This provides the curvature of the underside of the sailboard 12 for tight, fast turning and maneuverability. After a turn has been made and the sailboard 12 is starting its straightaway mode, the operator will move the left foot back under strap 85*a* to depress foot rear pedal 74 to lower the hinged panel 26 to its downward or straightaway position. Here again, fine turning may be desirable and this can be done by the operator's hand control or, alternatively, an automatic adjusting mechanism.

FIGS. 9 and 10 disclose a modification of the invention in which the fine turning of the adjusting screws 72 may be done by a remote controlled motor. In FIG. 9 it is seen that each screw 72 has a spur gear 87. Turning spur gear 87 adjusts its associated screw 72'. The spur gear 87 is controlled by an electromechanical mechanism generally indicated as drive control 88 which may be similar to the mechanism disclosed in U.S. Pat. No. 3,902,207. The drive control 88 would includes suitable gearing, a reversible electric motor, a radio receiver and battery power supply, all of conventional design.

Control of the electric motor in drive control 88 is by means of a remote transmitter 100 located in boom 89 as shown in FIG. 10. It is understood that the boom 89 is secured to the mast at its forward end (not shown) and is held by the operator when underway. Two buttons 90, 91 on the transmitter 100 are used to transmit forward and reverse signals to the drive control 88 in the panel section 32A. In this arrangement, the sailboard operator, when underway, may fine tune the panel adjusting screws 72' by means of the control buttons 90, 91 conveniently located on the boom.

A still further modification of the invention contemplates automatic adjustment of the panel adjusting screws in accordance with the speed of the sailboard 12 through the water. Thus, a speed detecting device 92 of any conventional construction is mounted in a convenient location as at the underside of panel 32A as shown in FIG. 9. The device 92 is wired directly to the control mechanism 88 to control the rotation of spur gears 84 to adjust screws 72' depending upon the speed of the sailboard.

The invention so far described may be considered a non-racing design and will provide improved straight sailing and turning. However, a modified version is used for optimum turning or jibing as in sailboard racing.

It is understood that when an operator desires to turn the sailboard 12 from a prior straightaway situation, he will depress the forward foot pedal 52 to raise the panel 26 for the turning movement. After the operator has jibed about, the operator will then depress the rear or speed trim foot pedal to return to the straightaway mode.

In a racing situation the turn is generally made about a turning mark and it is imperative that the operator maintain headway as much as possible and quickly get off on the new straightaway position after the operator has jibed about. In order to avoid losing significant headway, it is undesirable for the operator to maintain weight aft where it would serve to depress the rear end of the board and make starting again on the new heading more difficult. In jibing about, especially in a racing situation, where the sailor's weight is forward, it is necessary to operate the panel control mechanism from a more forward position.

Figure 11:
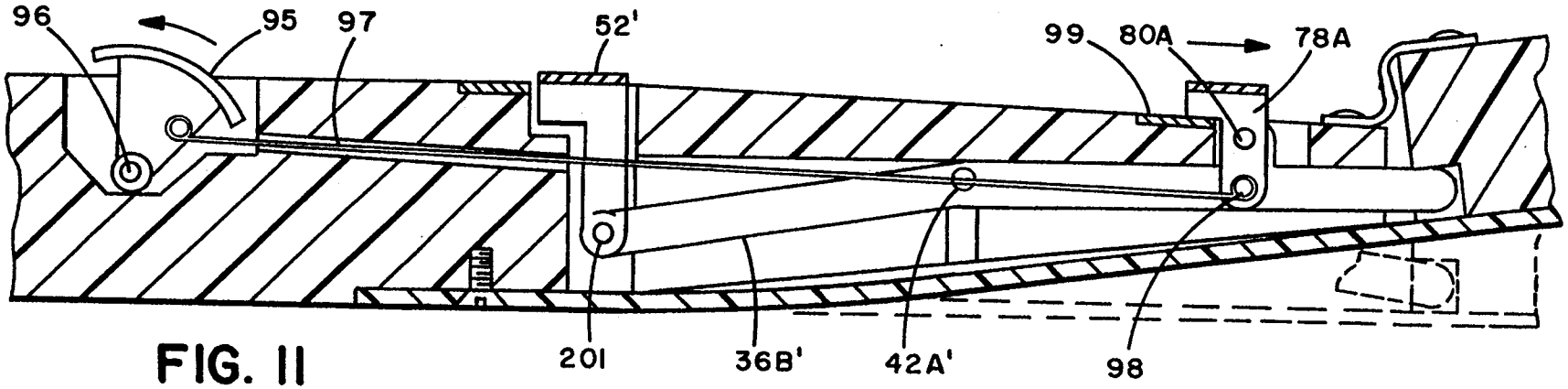
FIG. 11 is a modification of the embodiment shown in FIG. 5.
Figure 14:
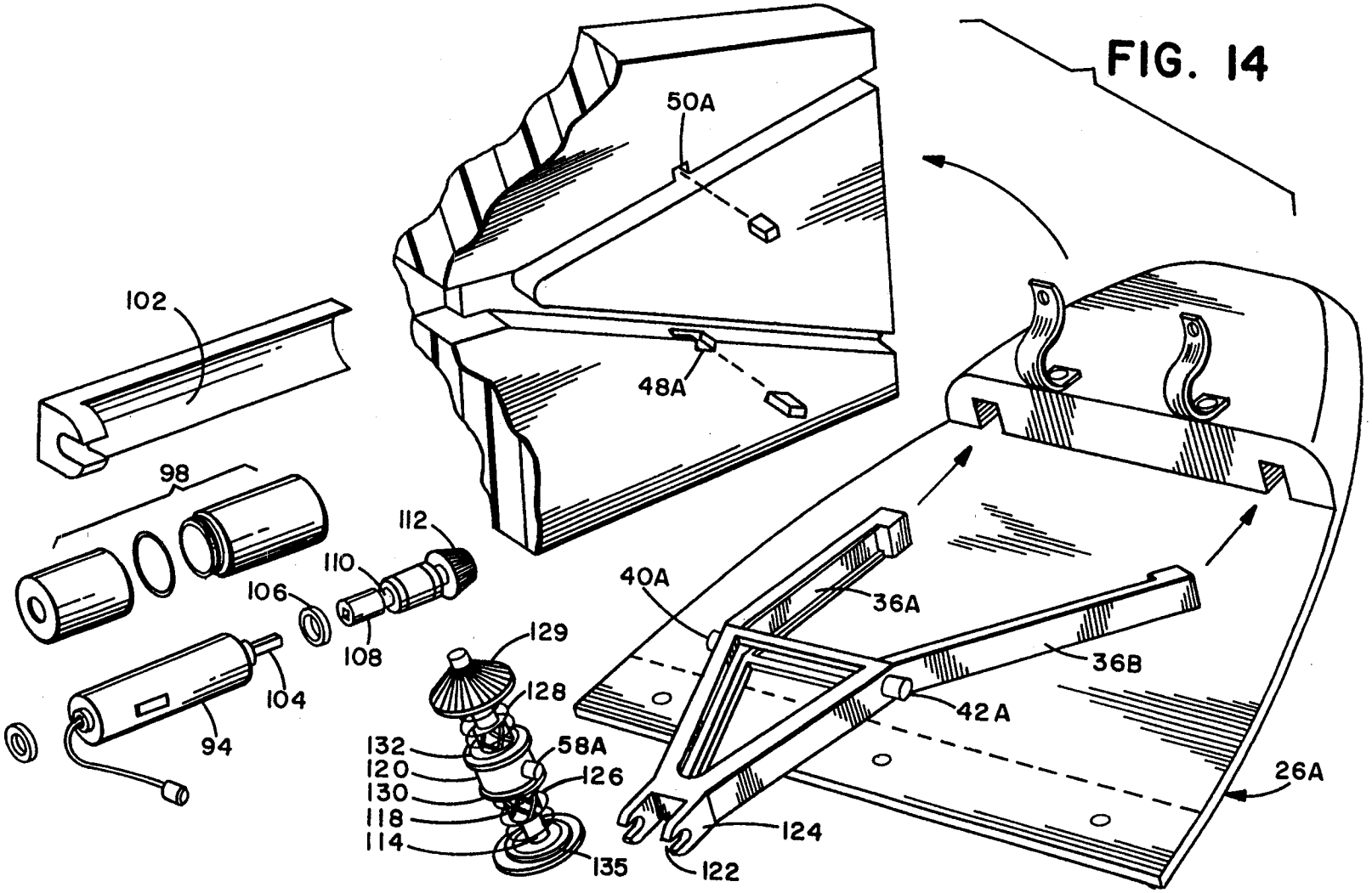
FIG. 14 is an exploded view of the power mechanism shown in FIG. 12.
Figure 15:
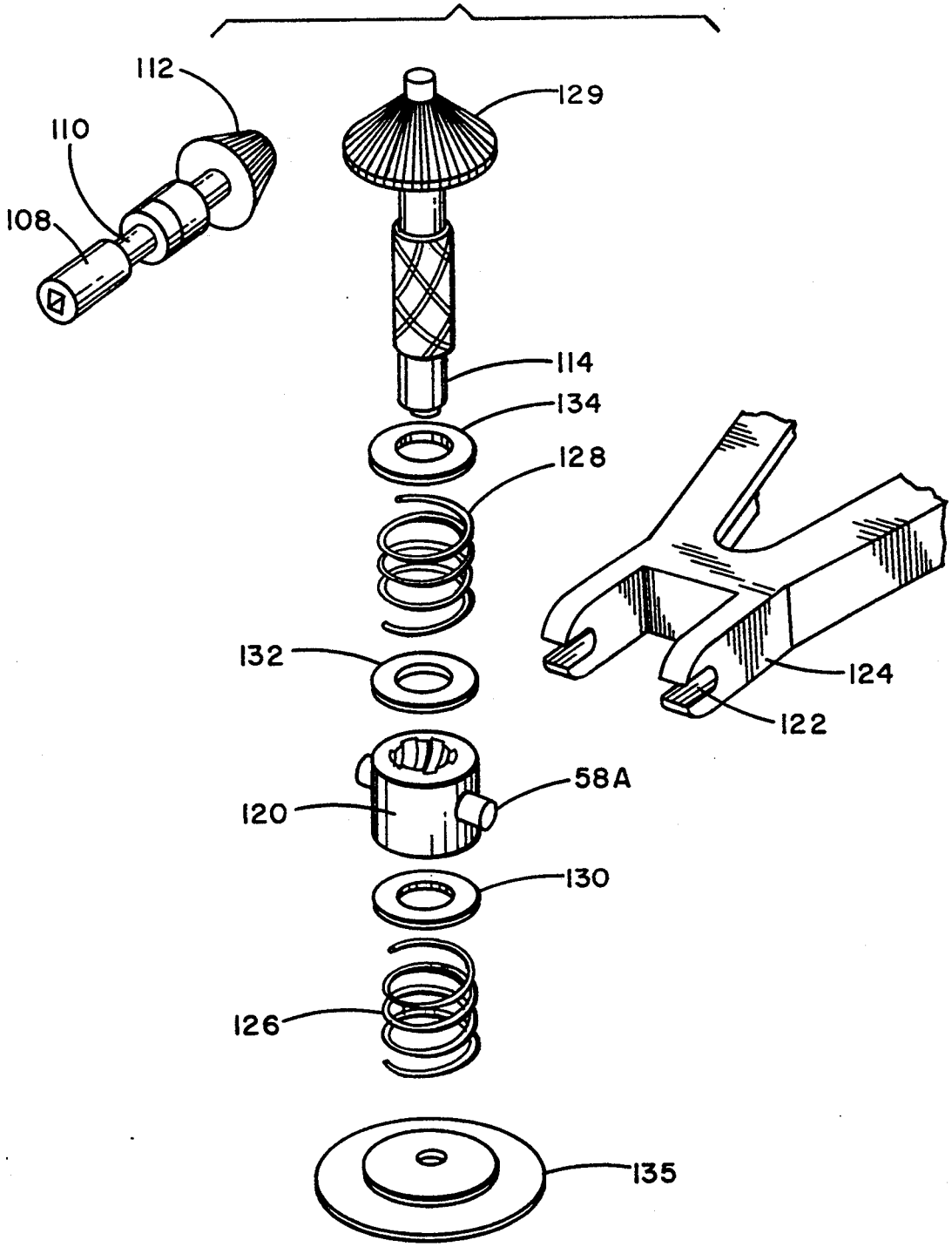
FIG. 15 is an exploded view of the gearing mechanism of the embodiment shown in FIG. 14.

FIG. 11 is a modification of the embodiment shown in FIG. 5 and features an additional pedal 95 pivoted about pin 96 and connected by cables 97 to extensions 98 of the pedal 74. Rotation of pedal 95 results in the cables 97 urging rotation around pin 80*a* and release of the pedal 78*a* from the striker plate 99, thereby causing arm 36B' to rotate about pivot pin 42A' so that pedal 52' moves up and rotates around pin 201. This allows the operator to remain in the forward position and still change the position of the panel 26 from its convex shape to its relatively flat shape shown in dashed outline.

An alternate approach is to have the invention operate by hand controls rather than foot controls. For this embodiment, hand operated switches are mounted on the boom to control the panel 26 as shown in the embodiment of FIGS. 12 through 15.

In describing the electrically driven embodiment of the invention, it can be seen that many of the parts are similar to those described above in connection with the foot control embodiment and these corresponding parts will carry the same number followed by the designation "A". As shown in FIGS. 12–15, the sailboard 12A has a rear panel 26A secured to the rear end of the sailboard 12A by screws 29A. The panel 26A includes a watertight compartment 32A and flat thin portion 30A secured to the sailboard 12A in a hinged manner. Similarly, this embodiment includes a pair of pivoting arms 36A, 38A each having a pivot pin 40A, 42A that are received in recesses 48A, 50A in the underside of the sailboard 12A.

In this embodiment, the foot operated mechanism is replaced by a power unit reversible motor 94 is enclosed in a watertight casing 98 which is located in a watertight cutout section 100 in the surface of the board 12A. A top plate 102 is placed over the cutout compartment 100 when the reversible motor is a place. The motor shaft 104 passing through a washer 106 is received in a connector 108 which in turn connects through an appropriate socket 110 to a bevel gear 112. The reversible motor controls the direction and turning of the bevel gear 112.

Shaft 114 carries a high speed thread shaft 118 which meshes with a similarly high speed threaded collar 120 having a pair of extending pins 58 A. The bottom end of shaft 114 is received in a hole 122 formed in a bottom plate 124 so that the shaft is free to rotate. A pair of springs 126, 128 and suitable washers 130, 132, 134 complete the drive assembly.

Pins 58A on collar 120 are received in slots 136 cut in the end projections 56A of pivoting arms 36A, 38A. It is seen then that rotation of the bevel gears will rotate shaft 114 causing collar 120 to travel vertically up and down which in turn will pivot the arms by reason of pins 58A engaging slots 36.

FIG. 12 shows the sailboard 12A design under sail and controlled by an operator. It is seen that the boom 89 is secured to the mast 141 in a customary manner. The boom 89 has suitable switches 142, 143 located within the boom 89 and having their control buttons exposed were they can be conveniently controlled by the operator. A similar set of control buttons are located on the other half of the boom 89 for operating when the sailboard 12A is on the other tack.

It is understood that the control switches 138 suitably connect to the reversible motor 94. The conductors 140 extend from the switches through the boom 89 and down the mast 141 to the sailboard 12A were they connect to the electric motor 94 by a suitable socket arrangement 142. Thus the closure of switch 138 by the operator will energize the electric motor 94 to turn in one direction whereas the closure of switch 139 will cause rotation in the other direction. In this manner, the operator is able to adjust the angle of panel 26A for optimum performance of the sailboard 12A.

It is of course understood that power sources other than an electric motor 94 may be employed. This may, for example, by hydraulic, compressed air or other power mechanisms.

From the above description it is seen that the operator can control the electric motor 94 from either side of the sailboard 12A by simply closing the appropriate electric switch 38. One switch will result in the motor going in one direction whereas the other switch will cause it to rotate in the opposite direction; and, in this manner, the operator can control the up and down movement of the rear panel 26A. The operator can set the angle in accordance with the wind and surf conditions and the type of sailing weather, straight away or turning, that he is doing at the time.

Although the invention has been described in regard to sailboards, it may be employed with other structures that require maneuverability as general boat hulls, surfboards and slalom skis.

Having thus described the invention with particular reference to the preferred forms thereof, it will be obvious that various changes and modifications may be made therein without departing from the spirit and scope of the invention as defined in the appended claims.

What is claimed is:

1. A sailboard for sailing in water; said sailboard comprising:

supporting means operable for receiving and supporting a sail mast;

an elongated hull fore and aft and having a top and a bottom;

a panel integrally connected to the bottom of said hull near the aft end and extending beyond the aft end; said panel being relatively rigid at its distal end; and moving means connected to both said hull and said panel, and operable for moving said distal end of said panel from a first position to a second position; said hull and said panel defining a relatively continuous flat surface for said first position and defining a relatively convex surface for said second position; said moving means comprising first and second pedal means operable for moving said panel between said first and second positions; said first and second pedal means being interconnected so that the movement of one causes the movement of the other; said first pedal means including a mechanical engagement for retaining said panel in its first position and said second pedal means including a a mechanical engagement for retaining said panel in its second position.

2. The sailboard as claimed in claim 1, further comprising adjusting means operable to adjust the position of said panel.

3. The sailboard as claimed in claim 1, further comprising a third pedal means connected to said second pedal means and operable for changing the position of said panel to its first position.

* * * * *